US012336636B2

(12) United States Patent
Eigenmann et al.

(10) Patent No.: US 12,336,636 B2
(45) Date of Patent: Jun. 24, 2025

(54) POSTURIZED POCKETED SPRING COMFORT LAYER

(71) Applicant: L&P Property Management Company, South Gate, CA (US)

(72) Inventors: Guido Eigenmann, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 1206 days.

(21) Appl. No.: 17/082,157

(22) Filed: Oct. 28, 2020

(65) Prior Publication Data

US 2021/0045539 A1 Feb. 18, 2021

Related U.S. Application Data

(63) Continuation of application No. 16/053,402, filed on Aug. 2, 2018, now abandoned.
(Continued)

(51) Int. Cl.
*A47C 27/06* (2006.01)
*A47C 7/34* (2006.01)
(Continued)

(52) U.S. Cl.
CPC ..... *A47C 27/064* (2013.01); *A47C 7/347* (2013.01); *A47C 7/35* (2013.01); *A47C 27/062* (2013.01); *A47C 27/07* (2013.01)

(58) Field of Classification Search
CPC ..... A47C 27/07; A47C 27/062; A47C 27/063; A47C 27/064; A47C 27/066; A47C 7/34; A47C 7/347; A47C 7/35
(Continued)

(56) References Cited

U.S. PATENT DOCUMENTS 4,234,983 A 11/1980 Stumpf
4,451,946 A 6/1984 Stumpf
(Continued)

FOREIGN PATENT DOCUMENTS

EP 1067090 A1 1/2001
EP 1707081 A1 10/2006
(Continued)

OTHER PUBLICATIONS

European Patent Office; Search Report and Written Opinion in related European Patent Application No. 19761002.5 dated Oct. 26, 2021; 8 pages.

*Primary Examiner* — David R Hare
(74) *Attorney, Agent, or Firm* — Wood Herron & Evans LLP

(57) ABSTRACT

A posturized comfort layer for a bedding or seating product has different sections of different firmness due to different mini coil springs within the sections. The springs may be individually pocketed between two sheets of non-woven polypropylene fabric joined with circular seams or rectangular seams. Each circular seam joins opposed pieces of fabric around one of the mini coil springs with curved segments. Alternatively, rectangular seams join opposed pieces of fabric around each of the mini coil springs with linear segments. Regardless of the shape of the seams, the different firmness of the different sections of the comfort layer may be due to the mini-coil springs contained in the pockets.

20 Claims, 14 Drawing Sheets

Related U.S. Application Data

(60) Provisional application No. 62/637,018, filed on Mar. 1, 2018.

(51) Int. Cl.
*A47C 7/35* (2006.01)
*A47C 27/07* (2006.01)

(58) Field of Classification Search
USPC ..... 5/720, 721
See application file for complete search history.

(56) References Cited

U.S. PATENT DOCUMENTS 4,485,506 A 12/1984 Stumpf et al.
4,574,099 A 3/1986 Nixon
4,594,278 A 6/1986 Nixon
5,105,488 A 4/1992 Hutchinson et al.
5,438,718 A 8/1995 Kelly et al.
5,740,574 A 4/1998 Piraino
5,987,678 A 11/1999 Ayers
6,154,908 A 12/2000 Wells
6,295,676 B1 10/2001 Warner
6,319,864 B1 11/2001 Hannigan et al.
6,447,874 B2 9/2002 Antinori et al.
6,537,930 B1 3/2003 Middlesworth et al.
6,591,438 B1 7/2003 Edling
6,598,251 B2 7/2003 Habboub et al.
6,602,809 B1 8/2003 Cabrey
6,684,435 B1 2/2004 Wells
6,706,225 B2 3/2004 Cabrey
6,826,796 B1 12/2004 Mossbeck
6,862,763 B2 3/2005 Mossbeck et al.
6,883,196 B2 4/2005 Barber
7,410,030 B2 8/2008 Fusiki et al.
7,622,406 B2 11/2009 Holland et al.
7,636,972 B2 * 12/2009 Mossbeck ..... A47C 27/053 5/716
7,788,952 B2 9/2010 Morrison
7,820,570 B2 10/2010 Holland et al.
7,828,029 B2 11/2010 Holland et al.
7,877,964 B2 * 2/2011 Spinks ..... B68G 9/00 53/529
8,011,046 B2 9/2011 Stjerna
8,087,114 B2 1/2012 Lundevall
8,136,187 B2 3/2012 Mossbeck et al.
8,157,051 B2 4/2012 Marcel et al.
8,322,487 B1 12/2012 Kitchen et al.
8,464,830 B2 6/2013 Ishikawa et al.
8,474,078 B2 7/2013 Mossbeck
8,574,700 B2 11/2013 Hattori
8,695,757 B2 4/2014 Duval et al.
9,133,615 B2 9/2015 Bischoff et al.
9,635,952 B1 5/2017 Anthony et al.
9,943,173 B2 4/2018 Krtek et al.
9,968,202 B2 5/2018 Long
10,076,193 B2 9/2018 Long
2002/0025747 A1 2/2002 Rock et al.
2003/0009831 A1 1/2003 Giori et al.
2003/0104735 A1 6/2003 Rock et al.
2004/0010853 A1 1/2004 Muci et al.
2004/0133988 A1 7/2004 Barber
2005/0273938 A1 12/2005 Metzger et al.
2007/0022538 A1 2/2007 Zschoch
2007/0044243 A1 3/2007 Metzger
2007/0094807 A1 5/2007 Wells
2007/0137926 A1 6/2007 Albin et al.
2007/0261548 A1 11/2007 Vrzalik et al.
2007/0289069 A1 12/2007 Wells
2008/0282476 A1 * 11/2008 Lundevall ..... A47C 27/063 5/720
2009/0211028 A1 8/2009 Richmond et al.
2009/0222985 A1 9/2009 Richmond et al.
2009/0298374 A1 12/2009 Delmas
2010/0212090 A1 8/2010 Stjerna
2010/0255270 A1 10/2010 Stuebiger
2011/0014406 A1 1/2011 Coleman et al.
2011/0099812 A1 5/2011 Spinks et al.
2011/0113551 A1 5/2011 Lin
2011/0314613 A1 * 12/2011 Haffner ..... A47C 23/007 5/721
2012/0102658 A1 5/2012 Mantzis et al.
2012/0167303 A1 7/2012 Stroh et al.
2013/0029550 A1 1/2013 Seth et al.
2013/0174350 A1 7/2013 Allman et al.
2013/0198941 A1 8/2013 John et al.
2014/0287643 A1 9/2014 Nozaki et al.
2014/0373282 A1 * 12/2014 Mossbeck ..... A47C 27/05 267/142
2015/0026893 A1 * 1/2015 Garrett ..... A47C 27/064 5/691
2015/0284901 A1 10/2015 Blackwell, Jr. et al.
2015/0359349 A1 12/2015 Eigenmann et al.
2016/0227938 A1 8/2016 Pennington et al.
2016/0235212 A1 * 8/2016 Krtek ..... B21F 27/16
2016/0235213 A1 8/2016 Long
2017/0251820 A1 9/2017 Long
2018/0049559 A1 * 2/2018 Jewett ..... A47C 27/05
2019/0343294 A1 11/2019 DeMoss et al.

FOREIGN PATENT DOCUMENTS

EP 2789267 A1 10/2014
GB 167025 A 8/1921
KR 200462261 Y1 9/2012
WO 2014023975 A1 2/2014
WO 2016130103 A1 8/2016

* cited by examiner

POSTURIZED POCKETED SPRING COMFORT LAYER

CROSS REFERENCE TO RELATED APPLICATIONS

This application is a continuation of U.S. patent application Ser. No. 16/053,402 filed Aug. 2, 2018 (pending), which claims the benefit of priority to U.S. Provisional Patent Application Ser. No. 62/637,018 filed Mar. 1, 2018 (expired). Each of these applications is fully incorporated by reference herein.

TECHNICAL FIELD OF THE INVENTION

This invention relates to a comfort layer for bedding and seating products. More particularly, this invention relates to a pocketed spring comfort layer for use in seating or bedding products.

BACKGROUND OF THE INVENTION

Comfort layers are commonly used in seating or bedding products above/below a core, which may or may not include a spring assembly. Such comfort layers may include foam, fiber and gel products. U.S. Pat. No. 8,087,114 discloses a comfort layer made of pocketed springs. Such spring assemblies may be made of strings of individually pocketed coil springs joined together or multiple coil springs joined together by helical lacing wires.

Comfort layers comprising mini pocketed coil springs have heretofore been a uniform firmness throughout. The mini pocketed coil springs have all been the same.

One desirable feature of known pocketed spring assemblies used as the core of bedding products is edge support, i.e., the perimeter of the pocketed spring assembly being firmer than a central portion of the pocketed spring assembly. Due to users sitting on the edge of a bedding or seating product, additional firmness around the perimeter of the product is desirable. Comfort layers are commonly used in seating or bedding products above/below a central core, which may or may not include a spring assembly. The central core is most commonly a pocketed or un-pocketed spring core, but the central core may be made partially or entirely of foam.

U.S. Pat. Nos. 9,968,202 and 9,943,173 each disclose a comfort layer made of pocketed mini coil springs configured to overlay a spring core of a bedding or seating product. Such comfort layers commonly have layers of fabric above below individually pocketed mini coil springs. The fabric is chosen to control air flow between pockets and into and out of the pockets.

One drawback to such pocketed spring comfort layers is that a mattress manufacturer may desire to place one or more foam or fiber layers above such a pocketed spring comfort layer so that a user does not detect or feel the pocketed spring comfort layer. In the case of a double-sided bedding or seating product, a mattress manufacturer may place one or more foam or fiber layers above one pocketed spring comfort layer and below another pocketed spring comfort layer on the opposite surface of the product.

It is therefore an objective of this invention to provide a pocketed spring comfort layer adapted to overlay a spring core of a seating or bedding product which may eliminate or reduce the need for a mattress manufacturer to place one or more foam or fiber layers above the pocketed spring comfort layer and yet obtain the effect of edge support.

It is another objective of this invention to provide a pocketed spring comfort layer adapted to overlay a spring core of a seating or bedding product which may reduce the number or thickness of foam or fiber layers a mattress manufacturer may elect to place above such a pocketed spring comfort layer, thereby reducing the cost of the finished mattress by the cost of such layers and the associated cost of applying them while still obtaining edge support.

It is another objective of this invention to provide a pocketed spring comfort layer for a seating or bedding product which has different regions or sections of different firmness.

Still another objective of this invention has been to provide a pocketed spring comfort layer for a seating or bedding product having edge support around the perimeter of the pocketed spring comfort layer.

SUMMARY OF THE INVENTION

The invention, which accomplishes these objectives, comprises a comfort layer for a seating or bedding product. The comfort layer comprises an assembly or matrix of individually pocketed springs, each spring being contained within a fabric pocket. The fabric pocketing material within which the springs are contained may be semi-impermeable to airflow through the fabric material. As used herein, the term "semi-impermeable" means that the fabric material permits airflow through the material, such as with a non-woven polypropylene material commonly used in the bedding industry.

Any of the embodiments of comfort layer shown or described herein may be incorporated into a bedding product, such as a mattress, foundation or pillow. Further, any of the embodiments of comfort layer shown or described herein may be incorporated into a seating product, such as a vehicle seat and/or office or residential furniture, such as a recliner. Alternatively, any of the embodiments of comfort layer shown or described herein may be sold independently as a retail or wholesale item. In such an application, the comfort layer may be added to and/or removed from a bedding or seating product by a customer. Most embodiments of comfort layer are configured to overlay a core of a bedding or seating product such as a pocketed spring core, for example.

According to one aspect of the invention, the comfort layer, whether incorporated inside a bedding or seating product or manufactured and sold as a separate product, comprises a matrix of interconnected mini pocketed springs. Each mini coil spring is contained within a pocket, the pocket having a weld seam around the pocket joining first and second pieces of fabric of the pocket. Each weld seam has multiple weld segments. In one embodiment, the comfort layer has a center section and a perimeter section surrounding the center section. The mini pocketed springs within the pockets of the center section are made of thinner wire than the wire from which the mini pocketed springs within the pockets of the perimeter section are made.

In some embodiments, the weld seams are circular, and the weld segments are curved. In other embodiments, the weld seams are rectangular and the weld segments straight. In most embodiments, the weld seams and the gaps therebetween are the same size. However, the weld seams may be different sizes.

The comfort layer, whether incorporated inside a bedding or seating product or manufactured and sold as a separate product, comprises a matrix of mini coil springs, a first piece of fabric on one side of the matrix of mini coil springs and a second piece of fabric on another side of the matrix of mini coil springs. The first and second pieces of fabric are joined with weld seams comprising weld segments around each of the mini coil springs to create gaps between the first and second pieces of fabric and individual pockets which contain the mini coil springs. The comfort layer has different sections of different firmness due, at least in part, to the out-of-pocket height of the mini coil springs.

The comfort layer, whether incorporated inside a bedding or seating product or manufactured and sold as a separate product, comprises mini coil springs, a first piece of fabric on one side of the mini coil springs and a second piece of fabric on another side of the mini coil springs. The first and second pieces of fabric are joined with weld seams comprising weld segments around each of the mini coil springs to create gaps of the same size between the weld segments and individual pockets which contain the mini coil springs. The comfort layer has different sections of different firmness due, at least in part, to the number of convolutions of the mini coil springs within the sections.

By changing the gauge of wire, number of convolutions/pitch of the mini-coil spring or out-of-pocket height or any combination thereof of the mini coil springs of different section of the comfort layer, a posturized comfort layer may be constructed.

BRIEF DESCRIPTION OF THE DRAWINGS

These and other objects and advantages of this invention will be more readily apparent from the following drawings, in which:

FIG. 3AA is a side elevational view of another mini coil spring for use in a firm section of any comfort layer described or shown herein;

FIG. 3BB is a cross-sectional view of one of the mini coil springs of FIG. 3AA being compressed and pocketed;

FIG. 4AA is a side elevational view of another mini coil spring for use in a soft section of any comfort layer described or shown herein;

FIG. 4BB is a cross-sectional view of one of the mini coil springs of FIG. 4AA being compressed and pocketed;

DETAILED DESCRIPTION OF THE DRAWINGS

Figure 1:
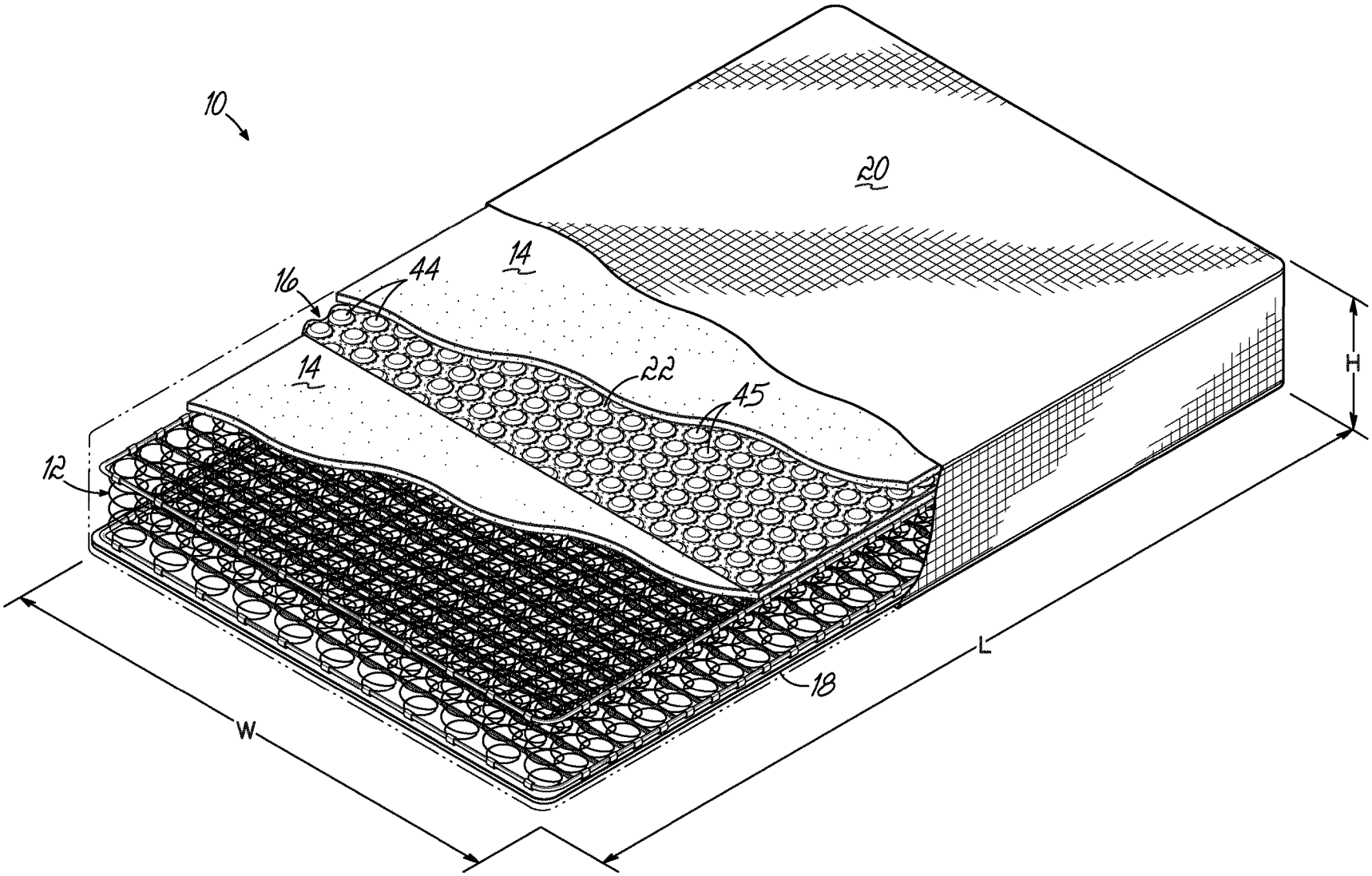
FIG. 1 is a perspective view, partially broken away, of a bedding product incorporating one of the comfort layers of this invention.

With reference to FIG. 1, there is illustrated a single-sided mattress 10 incorporating one embodiment of comfort layer in accordance with this invention. This mattress 10 comprises a spring core 12 over the top of which there is a conventional cushioning pad 14 which may be partially or entirely made of foam or fiber or gel, etc. The cushioning pad 14 may be covered by a comfort layer 16 constructed in accordance with the invention. A second conventional cushioning pad 14 may be located above the comfort layer 16. In some applications, one or both of the cushioning pads 14 may be omitted. This complete assembly may be mounted upon a base 18 and is completely enclosed within an upholstered cover 20.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

While several embodiments of comfort layer are illustrated and described as being embodied in a single-sided mattress, any of the comfort layers shown or described herein may be used in a single-sided mattress, double-sided mattress or seating cushion. In the event any such comfort layer is utilized in connection with a double-sided product, then the bottom side of the product's core may have a comfort layer applied over the bottom side of the core, and either comfort layer may be covered by one or more cushioning pads made of any conventional material. Either the cushioning pad or pads, on top and/or bottom of the core, may be omitted. The novel features of the invention reside in the comfort layer.

Although spring core 12 is illustrated being made of unpocketed coil springs held together with helical lacing wires, the core of any of the products, such as mattresses shown or described herein, may be made wholly or partially of pocketed coil springs (see FIG. 7), one or more foam pieces (not shown) or any combination thereof. Any of the comfort layers described or shown herein may be used in any single or double-sided bedding or seating product having any conventional core. This document is not intended to limit in any way the core. The core may be any conventional core including, but not limited to, pocketed or conventional spring cores.

Figure 7:
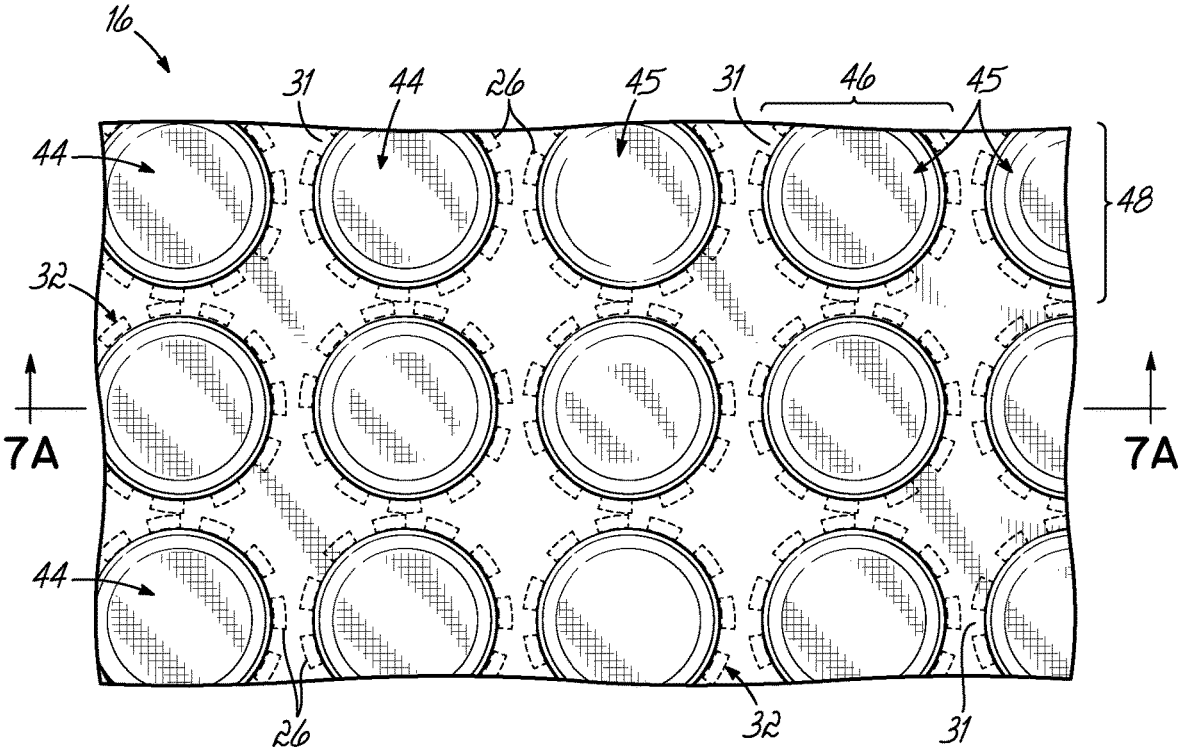
FIG. 7 is a top plan view of a portion of the comfort layer of FIG. 2.
Figure 7A:
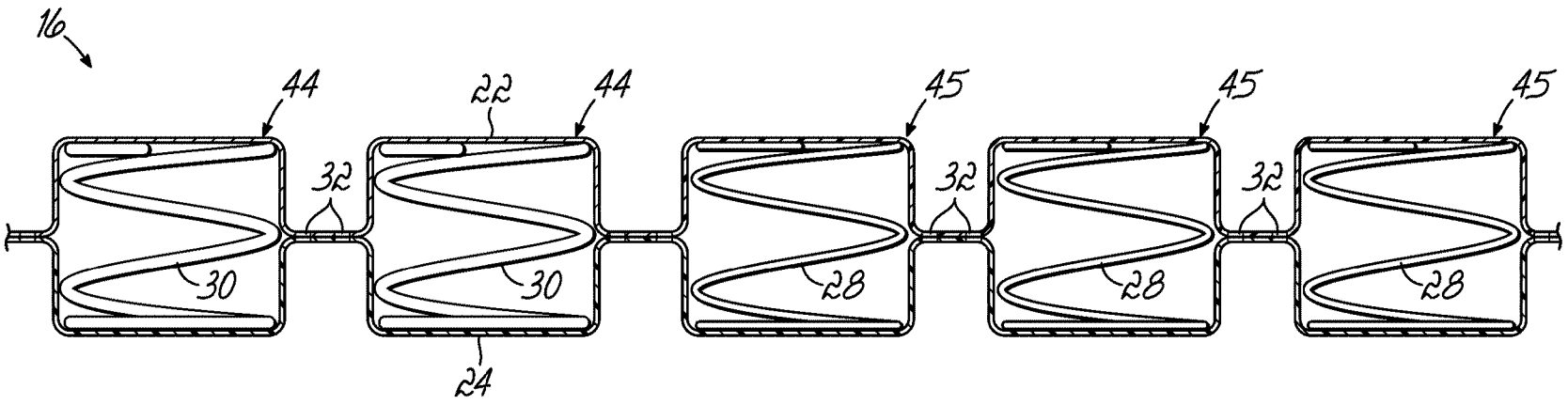
FIG. 7A is a cross-sectional view taken along the line 7A-7A of FIG. 7.
Figure 7B:
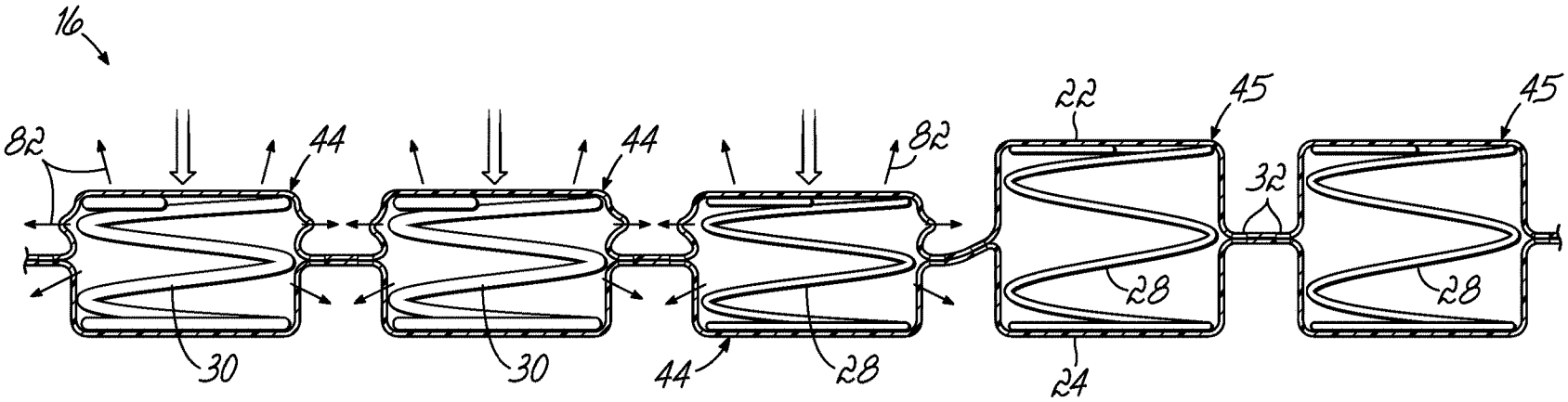
FIG. 7B is a cross-sectional view like FIG. 7A showing several pockets compressed.

FIG. 7A illustrates the components of one embodiment of comfort layer 16 incorporated into the mattress 10 shown in FIG. 1. The comfort layer 16 comprises a first or upper piece of fabric 22 and a second or lower piece of fabric 24 with a plurality of mini coil springs 28, 30 therebetween. The fabric pieces 22, 24 are joined together with circular containments or seams 32, each circular seam 32 surrounding a mini coil spring 28, 30. Each circular seam 32 comprises multiple arced or curved weld segments 26 with gaps 31 therebetween. The first and second pieces of fabric 22, 24 are joined together along each arced or curved weld segment 26 of each circular seam 32. The first and second pieces of fabric 22, 24 are not joined together along each gap 31 between adjacent weld segments 26 of each circular seam 32. The curved weld segments 26 are strategically placed around a mini coil spring 28, 30 and create the circular seam 32. The two pieces of fabric 22, 24, in combination with one of the the circular weld seams 32, define a cylindrical-shaped pocket 44, 45 inside of which is at least one mini coil spring 28, 30. See FIGS. 7 and 7A.

During the welding process, the mini coil springs 28 may be at least partially compressed before pocket 44, 45 is closed and thereafter. If desired, resilient members other than mini coil springs, such as foam members, may be used. Alternatively, resilient members made of resilient material, other than foam which returns to its original configuration after a load is removed from the material, may be used inside the pockets.

Figure 8:
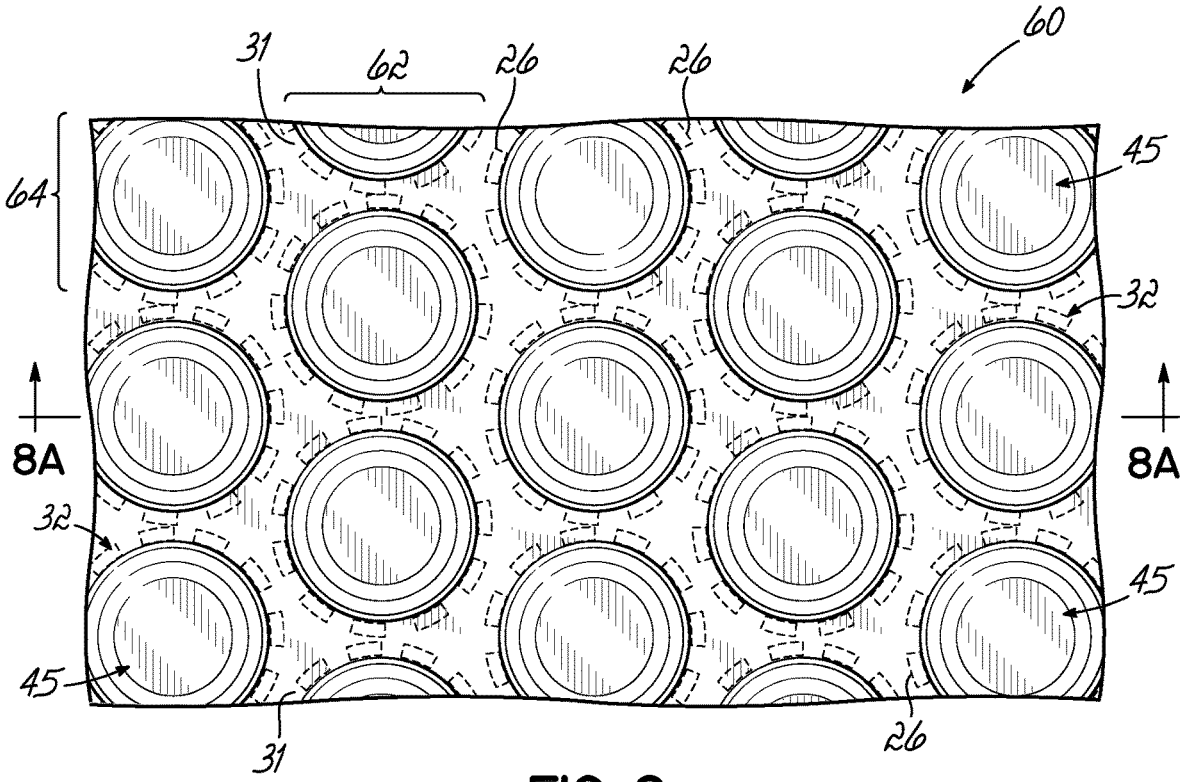
FIG. 8 is a top plan view of a portion of another comfort layer, the arrows showing airflow inside the comfort layer.
Figure 8A:
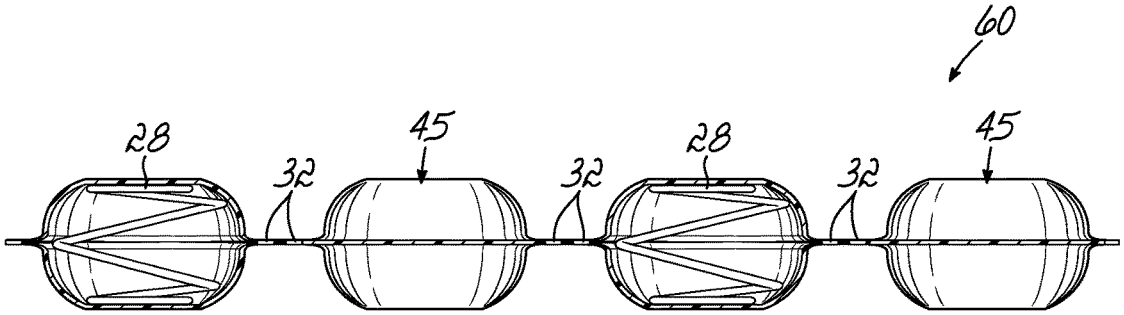
FIG. 8A is a cross-sectional view taken along the line 8A-8A of FIG. 8.

The size of the curved weld segments 26 of circular seams 32 are not intended to be limited by the illustrations; they may be any desired size. Similarly, the size, i.e., diameter of the illustrated circular seams 32, is not intended to be limiting. The placement of the circular seams 32 shown in the drawings is not intended to be limiting either. For example, the circular seams 32 may be organized into aligned rows and columns, as shown in FIGS. 7 and 7A or may be organized with adjacent columns being offset from each other, as illustrated in FIGS. 8 and 8A. Any desired arrangement of seams may be incorporated into any embodiment shown or described herein.

The weld segments may assume shapes other than the curved weld segments illustrated. For example, the welds or seams may be circular around mini coil springs, but the weld segments may assume other shapes, such as triangles or circles or ovals of the desired size and pattern.

Figure 2:
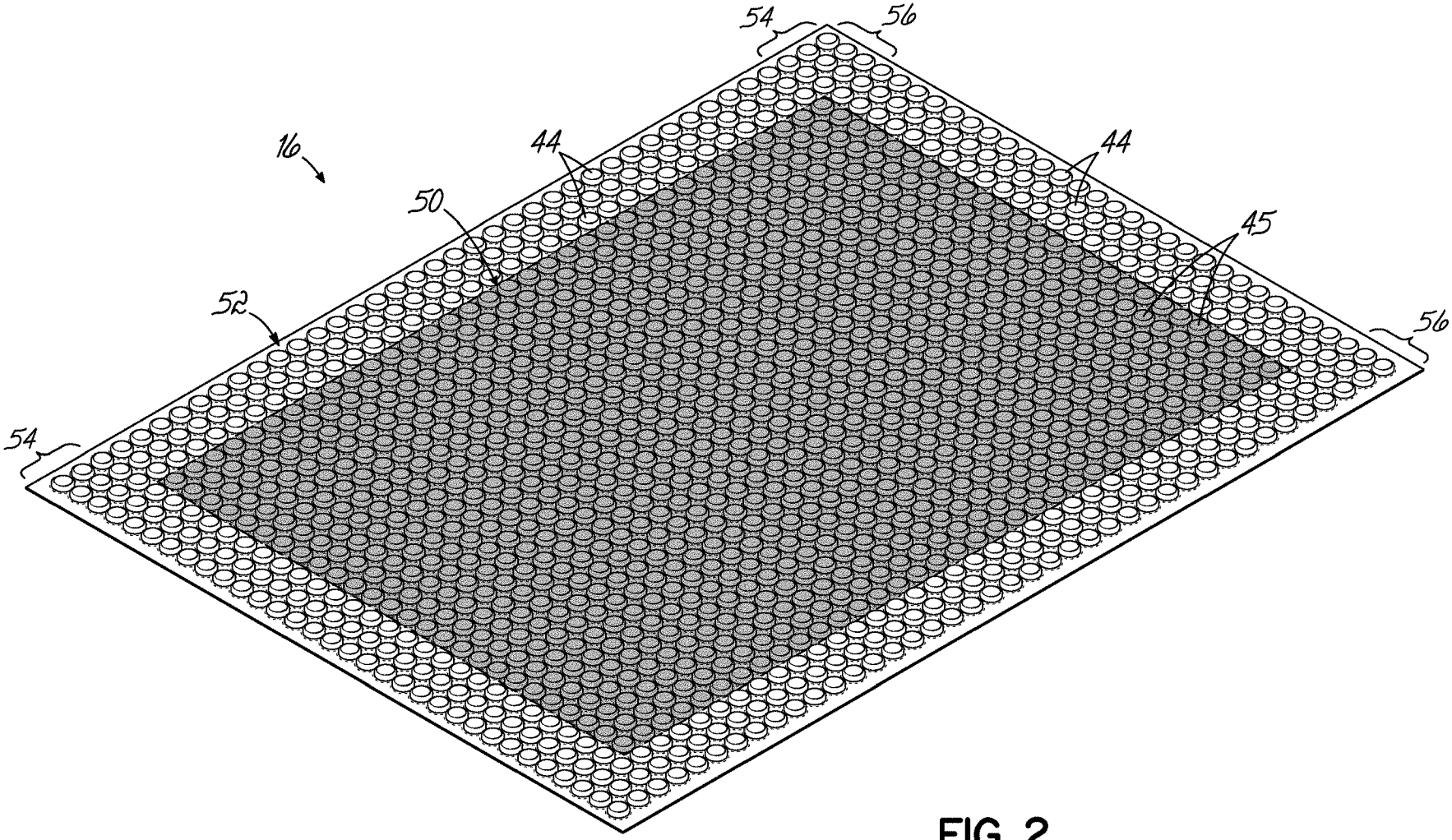
FIG. 2 is a perspective view of the comfort layer used in the bedding product of FIG. 1.

FIG. 2 illustrates the comfort layer 16 having a center section 50 and a perimeter section 52 surrounding the center section 50. The perimeter section 52 has the shape of a picture frame comprising two end sections 54 and two side sections 56. The center section 50 is generally rectangular shaped and located inside the perimeter section 52.

The center and perimeter sections 50, 52, respectively, have identical pockets 45, 44, respectively, made of the same materials, first and second pieces 22, 24 of non-woven polypropylene fabric in one embodiment. Each of the mini coil springs 28 of the center section 50 may be a "soft" mini coil spring 28, as described below and shown in FIGS. 3A and 3B. Each of the mini coil springs 30 of the perimeter section 52 may be a "firm" mini coil spring 30, as described below and shown in FIGS. 4A and 4B. However, the mini coil springs of the center section 50 may be any "soft" mini coil springs shown or described herein and the mini coil springs of the perimeter section 52 "firm" coil springs.

Figure 3A:
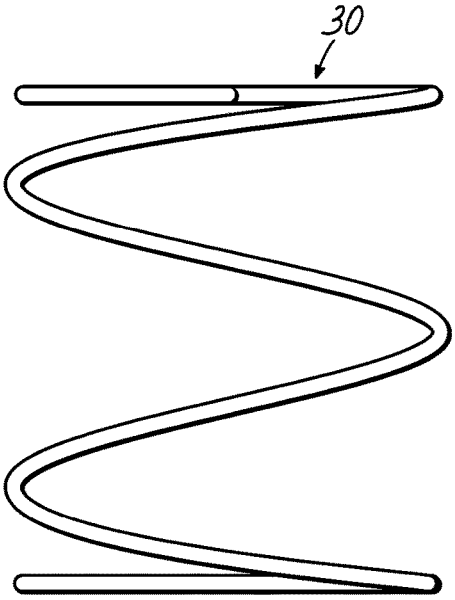
FIG. 3A is a side elevational view of one of the mini coil springs used in the perimeter section of the comfort layer of FIG. 2.
Figure 3B:
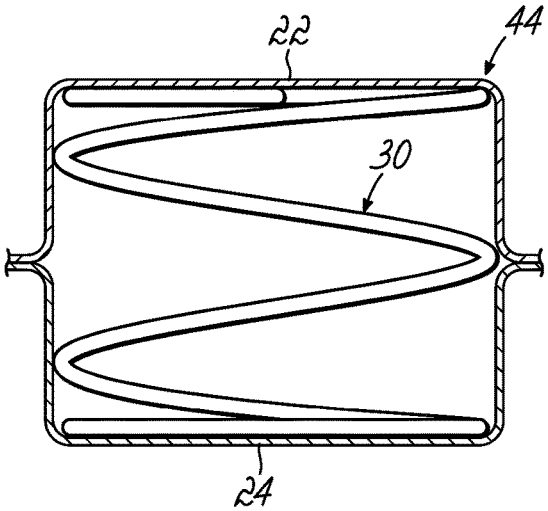
FIG. 3B is a cross-sectional view of one of the mini coil springs of FIG. 3A being compressed and pocketed.

FIG. 3A illustrates one "firm" mini coil spring 30 used in the perimeter section 52 of the comfort layer 16 in a relaxed condition. In such a condition, "firm" mini coil spring 30 may be approximately 0.5 to 3.0 inches tall, have a diameter of approximately 1.5 inches and be made of seventeen-gauge wire. As shown in FIG. 3B, while compressed inside one of the pockets 44, each of the "firm" mini coil springs 30 is shorter than when out-of-pocket or in a relaxed condition. In one embodiment, each of the compressed "firm" mini coil springs 30 is approximately one inch tall.

Figure 4A:
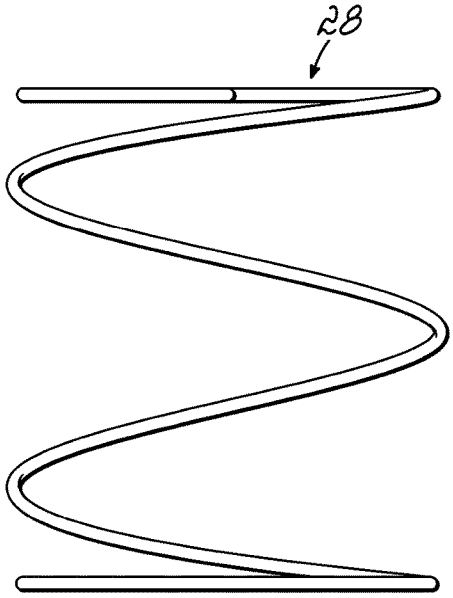
FIG. 4A is a side elevational view of one of the mini coil springs used in the center section of the comfort layer of FIG. 2.
Figure 4B:
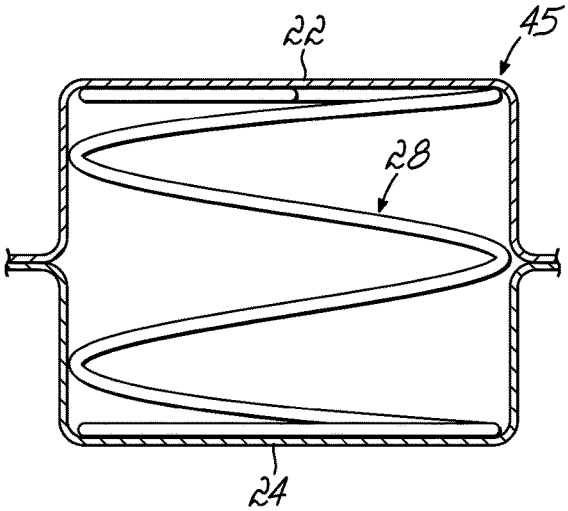
FIG. 4B is a cross-sectional view of one of the mini coil springs of FIG. 4A being compressed and pocketed.
Figure 3A:
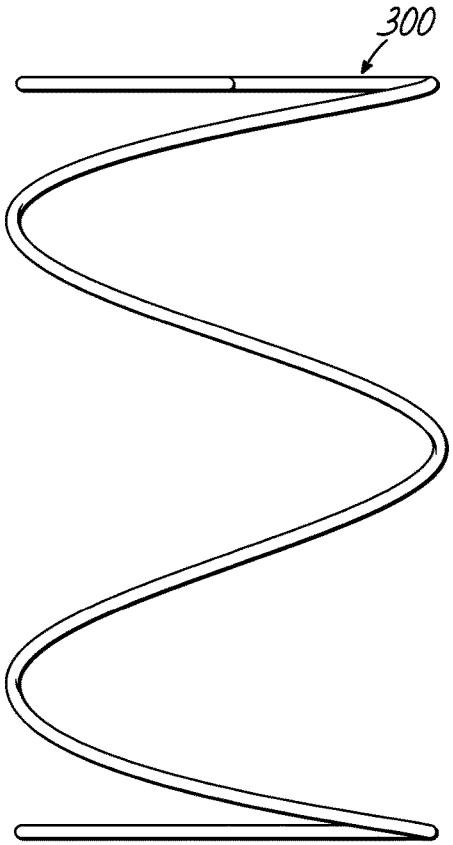
Figure 4A:
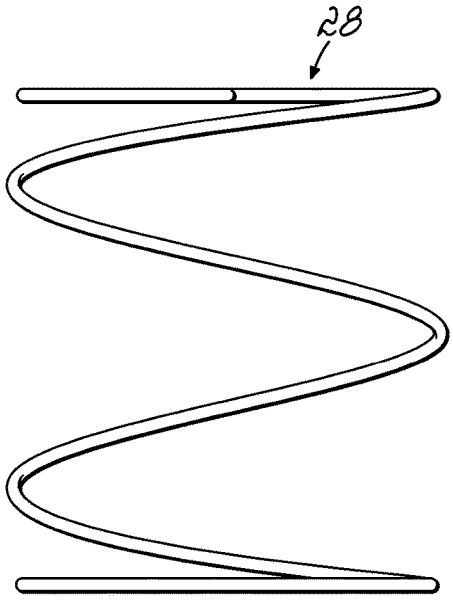
Figure 3B:
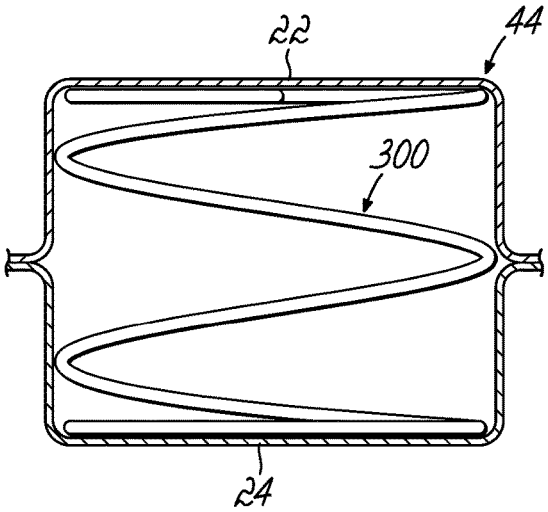
Figure 4B:
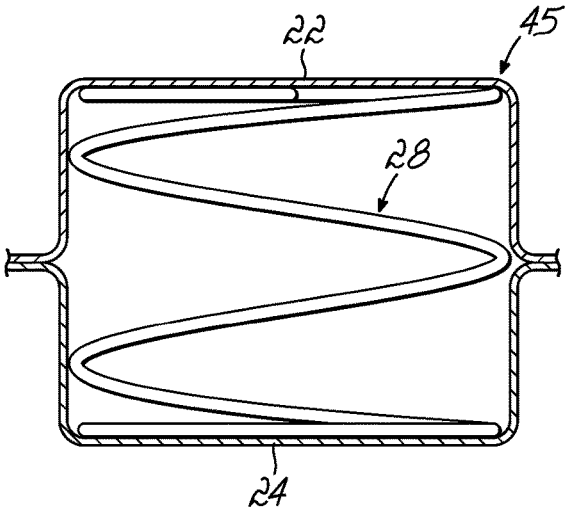

As shown in FIG. 4A, each "soft" mini coil spring 28 in a relaxed condition may be approximately 0.5 to 3.0 inches tall, have a diameter of approximately 1.5 inches and be made of nineteen-gauge wire. As shown in FIG. 4B, being compressed inside one of the pockets 45, each of the "soft" mini coil springs 28 is shorter than when out-of-pocket or in a relaxed condition. In one embodiment, each of the compressed "soft" mini coil springs 28 is approximately one inch tall.

As shown in FIGS. 3AA, 3BB, 4AA and 4BB, another method of changing the firmness of the mini coil springs is to change the out-of-pocket height of the mini coil springs rather than change the wire gauge or the number of convolutions or turns. FIG. 3AA illustrates another mini coil spring 300 which, when compared to mini coil spring 28 of FIG. 4AA, is a "firm" mini coil spring for use in any firm section of any comfort layer described or shown herein including perimeter section 52 of the comfort layer 16. Mini coil spring 28 shown in a relaxed or uncompressed condition in FIG. 4AA will be considered a "soft" mini coil spring for use for use in any soft section of any comfort layer described or shown herein including in the center section 50 of the comfort layer 16. FIG. 3BB illustrates "firm" mini coil spring 300 compressed inside one of the pockets 44, approximately one inch tall. Likewise, FIG. 4BB illustrates "soft" mini coil spring 28 compressed inside one of the pockets 45, approximately one inch tall.

Figure 5A:
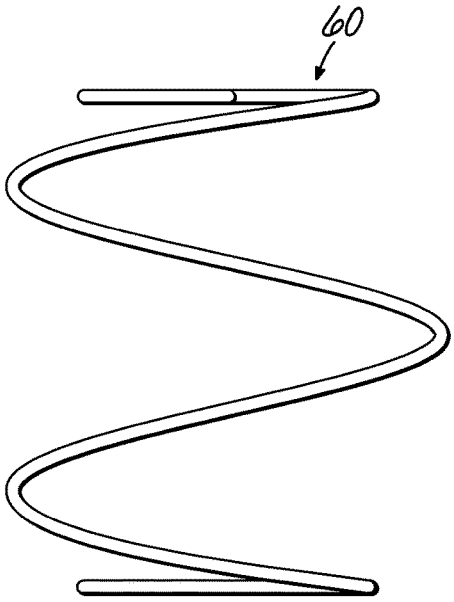
FIG. 5A is a side elevational view of another mini coil spring which may be used in a firm section of any comfort layer described or shown herein.
Figure 6A:
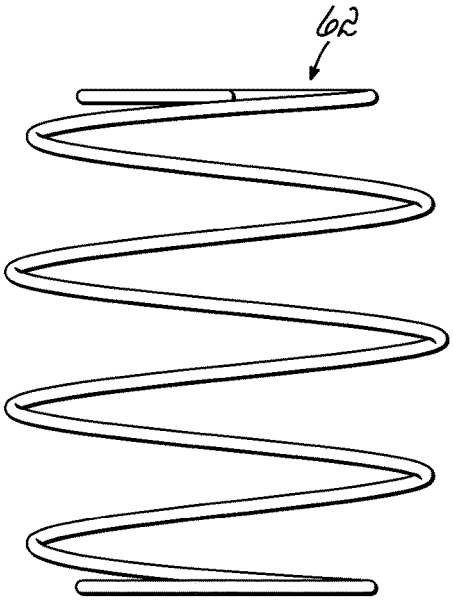
FIG. 6A is a side elevational view of a mini coil spring which may be used in a soft section of any comfort layer described or shown herein.
Figure 5B:
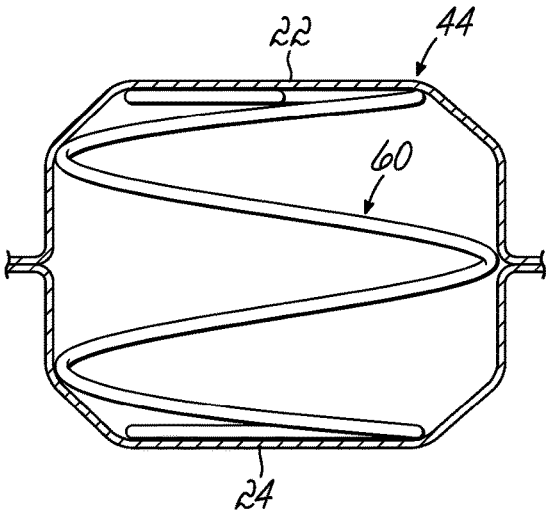
FIG. 5B is a cross-sectional view of one of the mini coil springs of FIG. 5A being compressed and pocketed.
Figure 6B:
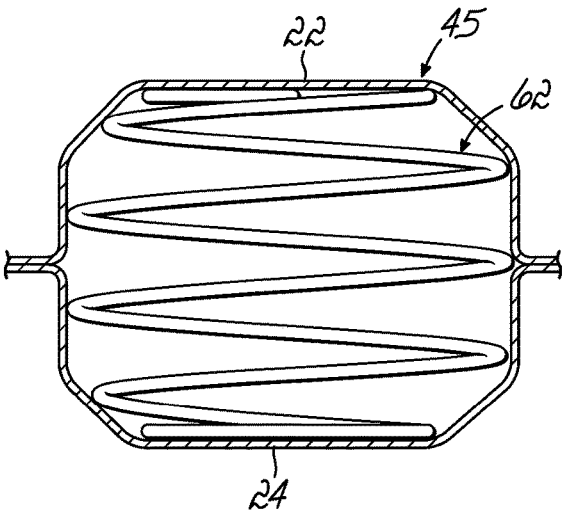
FIG. 6B is a cross-sectional view of one of the mini coil springs of FIG. 6A being compressed and pocketed.

As shown in FIGS. 5A, 5B, 6A and 6B, another method of changing the firmness of the mini coil springs is to change the number of convolutions or turns of the mini coil spring rather than change the wire gauge or the out-of-pocket height. FIG. 5A illustrates another mini coil spring 60 which, when compared to mini coil spring 62 of FIG. 5B, will be considered a "firm" mini coil spring for use in any firm section of any comfort layer described or shown herein including the perimeter section 52 of the comfort layer 16. Mini coil spring 62 shown in a relaxed or uncompressed condition in FIG. 6A will be considered a "soft" mini coil spring for use in any soft section of any comfort layer described or shown herein including the center section 50 of the comfort layer 16. FIG. 5B illustrates "firm" mini coil spring 60 compressed inside one of the pockets 44, approximately one inch tall. Likewise, FIG. 6B illustrates "soft" mini coil spring 62 compressed inside one of the pockets 45, approximately one inch tall.

Any of the spring characteristics such as wire gauge, out-of-pocket height, number of convolutions or any combination thereof may be used to differentiate mini-coil springs, the firmer mini coil springs being used in the firmer sections of any comfort layer shown or described herein and the softer mini coil springs being used in the softer sections of any comfort layer shown or described herein.

Any of the mini coil springs shown or described herein in a relaxed condition may be any desired height, have any desired shape, such as an hourglass or barrel shape, and be made of any desired wire thickness or gauge and have any number of convolutions. The drawings are not intended to be limiting.

In the embodiments in which the fabric material of pieces 22, 24 defining pockets 44, 45 and enclosing the mini coil springs 28, 30 therein is semi-permeable to airflow, upon being subjected to a load, a pocket 44, 45 containing at least one mini coil spring 28, 30 is compressed by compressing the mini coil spring(s) 28, 30 contained within the pocket(s) 44, 45.

As best illustrated in FIG. 7, the individual pockets 44, 45 of comfort layer 16 may be arranged in longitudinally extending columns 46 extending from head-to-foot of the bedding product and transversely extending rows 48 extending from side-to-side of the bedding product. As shown in FIGS. 7 and 8A, the individual pockets 44, 45 of one column 46 are aligned with the pockets 44, 45 of adjacent columns 46.

FIGS. 8 and 8A illustrate a center section of another comfort layer 60 having the same pockets 45 and same mini coil springs 28 as does the embodiment of comfort layer 16 of FIGS. 1-7B. As best illustrated in FIG. 8, the individual pockets 45 of comfort layer 60 are arranged in longitudinally extending columns 62 extending from head-to-foot of the bedding product and transversely extending rows 64 extending from side-to-side of the bedding product. As shown in FIGS. 8 and 8A, the individual pockets 45 of one column 62 are offset from, rather than aligned with, the pockets 45 of the adjacent columns 62.

Figure 9:
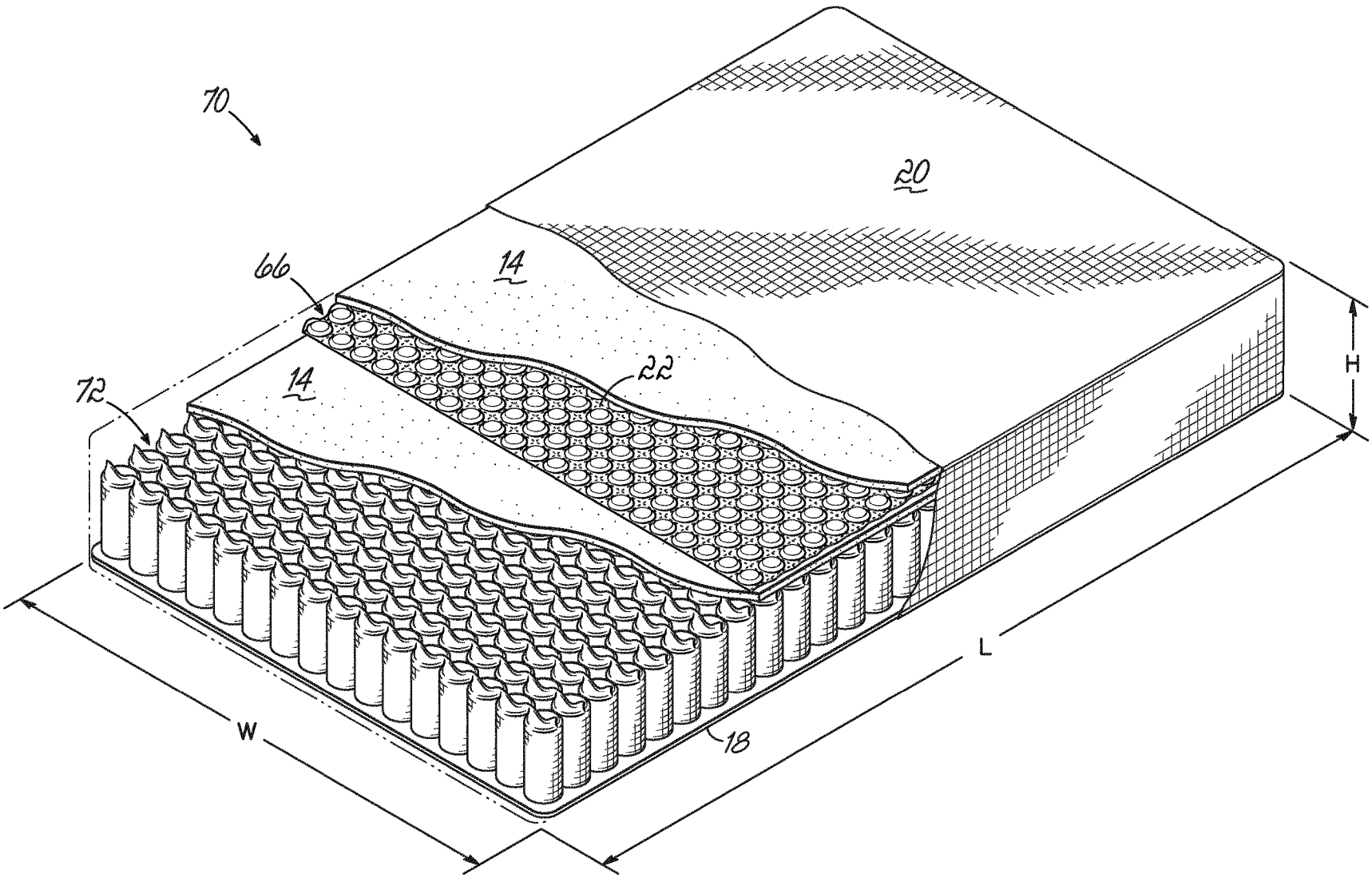
FIG. 9 is a perspective view, partially broken away, of a bedding product incorporating another embodiment of comfort layer in accordance with the invention.

FIG. 9 illustrates an alternative embodiment of comfort layer 66 incorporated into a single-sided mattress 70. Single-sided mattress 70 comprises a pocketed spring core 72, a cushioning pad 14 on top of the pocketed spring core 72, a base 18, another cushioning pad 14 above comfort layer 66, and an upholstered covering material 20. Pocketed spring core 72 may be incorporated into any bedding or seating product, including a double-sided mattress, and is not intended to be limited to single-sided mattresses. As described above, at least one comfort layer 66 may be used in any conventional core, including a spring core made with non-pocketed conventional springs. At least one comfort layer 66 may be used in any single or double-sided bedding or seating product.

As shown in FIG. 9, mattress 70 has a longitudinal dimension or length L, a transverse dimension or width W and a height H. Although the length L is shown as being greater than the width W, they may be identical. The length, width and height may be any desired distance and are not intended to be limited by the drawings.

Figure 10:
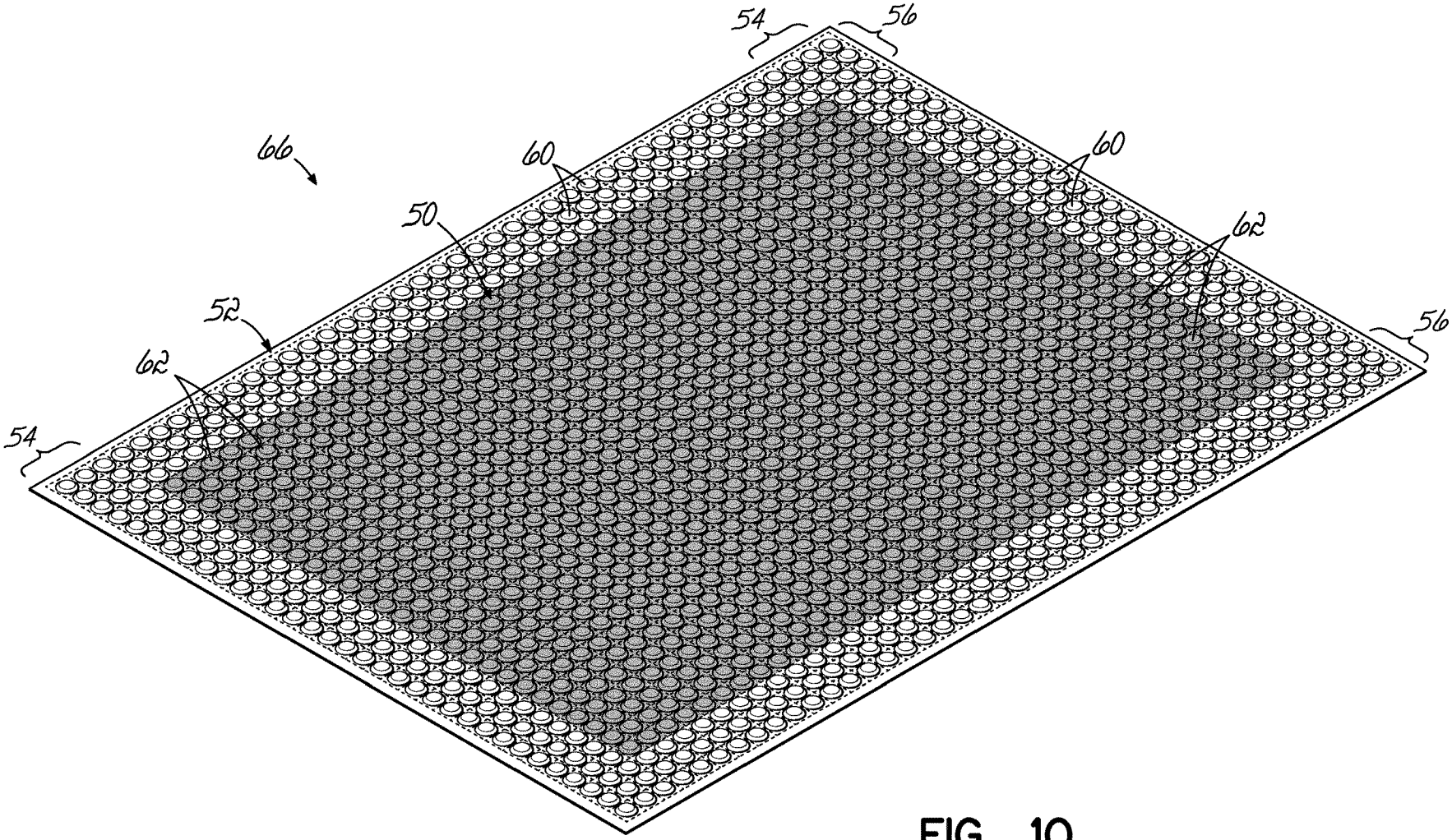
FIG. 10 is a perspective view of the comfort layer used in the bedding product of FIG. 9.

FIG. 10 illustrates the comfort layer 66 having a center section 150 and a perimeter section 152 surrounding the center section 150. The perimeter section 152 has the shape of a picture frame comprising two end sections 154 and two side sections 156. The center section 150 is generally rectangular shaped and located inside the perimeter section 152.

The center and perimeter sections 150, 152, respectively, have identical pockets 45, 44, respectively, made of the same materials, first and second pieces 22, 24 of non-woven polypropylene fabric in one embodiment. Each of the mini coil springs 28 of the center section 50 may be a "soft" mini coil spring 28, as described below and shown in FIGS. 3A and 3B. Each of the mini coil springs 30 of the perimeter section 52 may be a "firm" mini coil spring 30, as described below and shown in FIGS. 4A and 4B. However, the mini coil springs of the center section 50 may be any "soft" mini coil springs shown or described herein and the mini coil springs of the perimeter section 52 "firm" coil springs.

Figure 11:
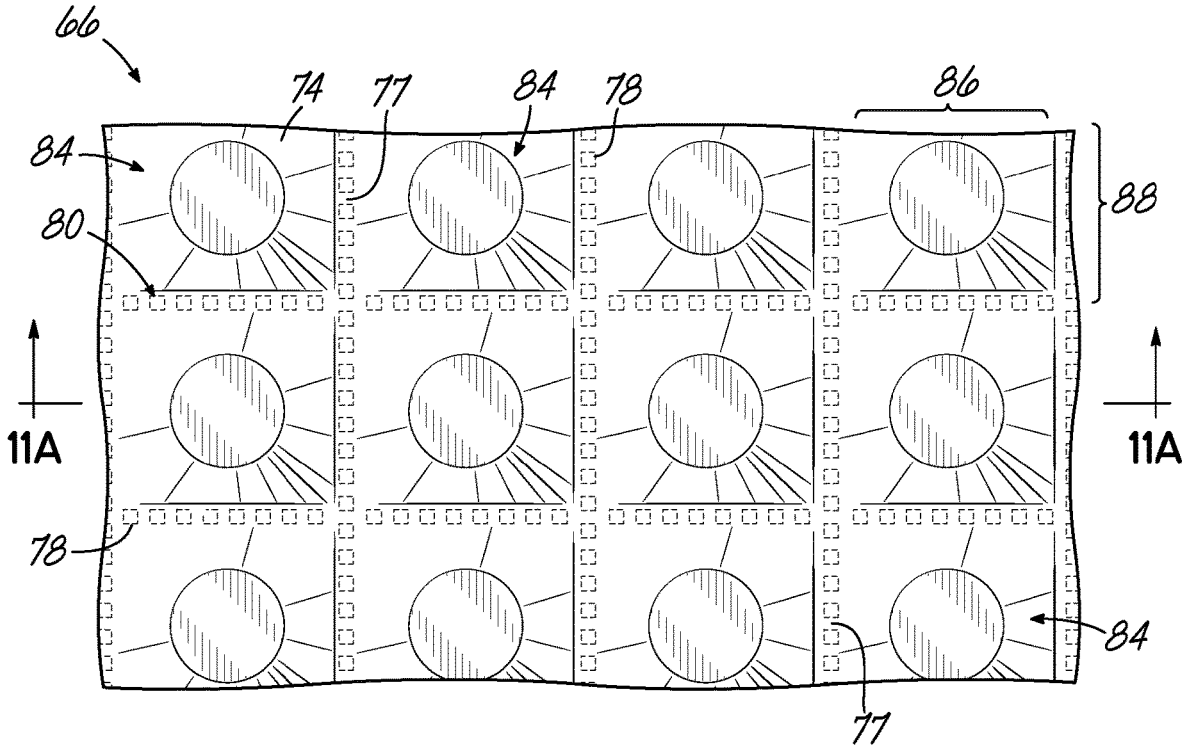
FIG. 11 is a top plan view of a portion of the comfort layer of FIG. 10.
Figure 11A:
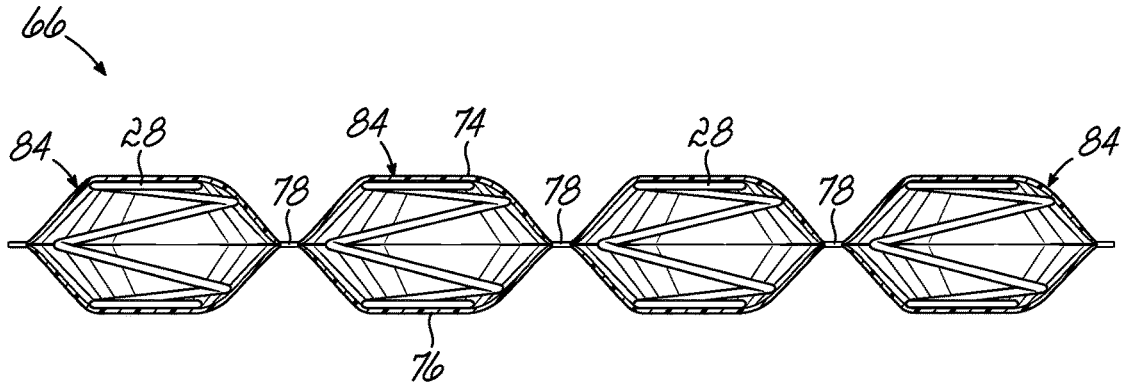
FIG. 11A is a cross-sectional view taken along the line 11A-11A of FIG. 11.

FIGS. 11 and 11A illustrate the components of the comfort layer 66 incorporated into the mattress 70 shown in FIG. 9. The comfort layer 66 comprises a first piece of fabric 74 and a second piece of fabric 76 joined together with multiple intersecting linear seams 80. Each linear seam 80 comprises multiple linear weld segments 78. These linear weld segments 78 are strategically placed around a mini coil spring 28 and create a rectangular pocket 84. During the welding process, the mini coil springs 28, 30 may be compressed. The length and/or width of the linear weld segments 78 of linear seams 80 is not intended to be limited to those illustrated; they may be any desired size. Similarly, the size of the illustrated linear seams 80 is not intended to be limiting. Shapes other than linear weld segments may be used to create rectangular seams. Such shapes may include, but are not limited to, triangles or circles or ovals of any desired size.

In some embodiments, the fabric material defining pockets 84 and enclosing the mini coil springs 28, 30 therein is semi-permeable to airflow. In accordance with the practice of this invention, one fabric material semi-impermeable to airflow, which may be used in either of the two pieces of the pocketed spring comfort layers disclosed or shown herein, may be a multi-layered material.

As best illustrated in FIG. 11, the individual pockets 84 of comfort layer 66 may be arranged in longitudinally extending columns 86 extending from head-to-foot of the bedding product and transversely extending rows 88 extending from side-to-side of the bedding product. As shown in FIGS. 11 and 11A, the individual pockets 84 of one column 86 are aligned with the pockets 84 of the adjacent columns 86.

Figure 12:
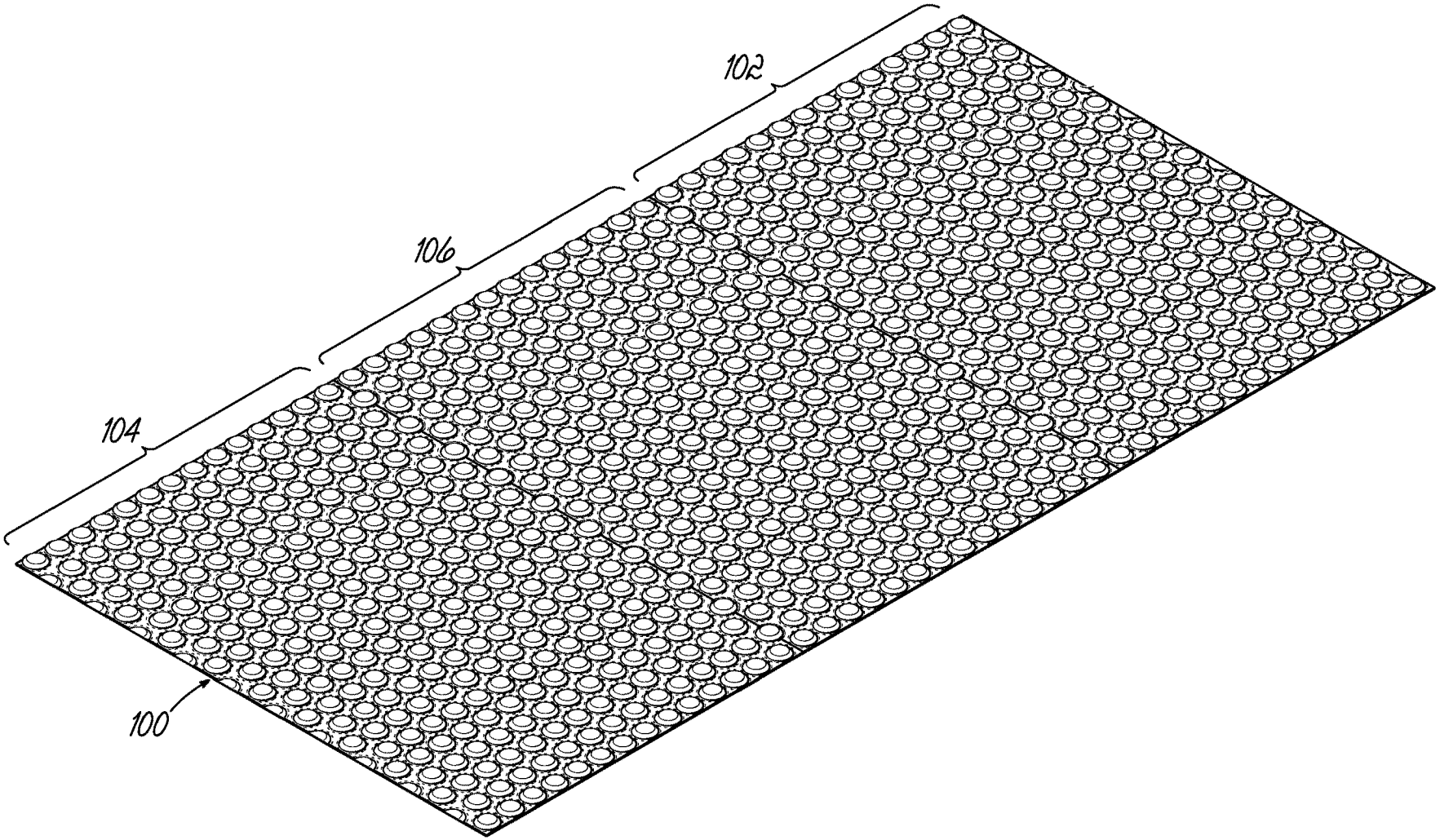
FIG. 12 is a perspective view of another posturized comfort layer.

FIG. 12 illustrates another posturized comfort layer 100 having three different areas or regions of firmness depending upon the airflow within each of the areas or regions. The comfort layer 100 has a head section 102, a foot section 104 and a lumbar or middle section 106 therebetween. The size and number of segments in the seams, along with the type of material used to construct the posturized comfort layer 100, may be selected so at least two of the sections may have a different firmness due to different springs within different sections. Although three sections are illustrated in FIG. 12, any number of sections may be incorporated into a posturized comfort layer. Although each of the sections is illustrated being a certain size, they may be other sizes. The drawings are not intended to be limiting. Although FIG. 11 shows each of the segmented seams of comfort layer 100 being circular, posturized comfort layer 100 may have rectangular segmented seams, such as the rectangular segmented seams shown in FIGS. 11 and 11A.

Figure 13:
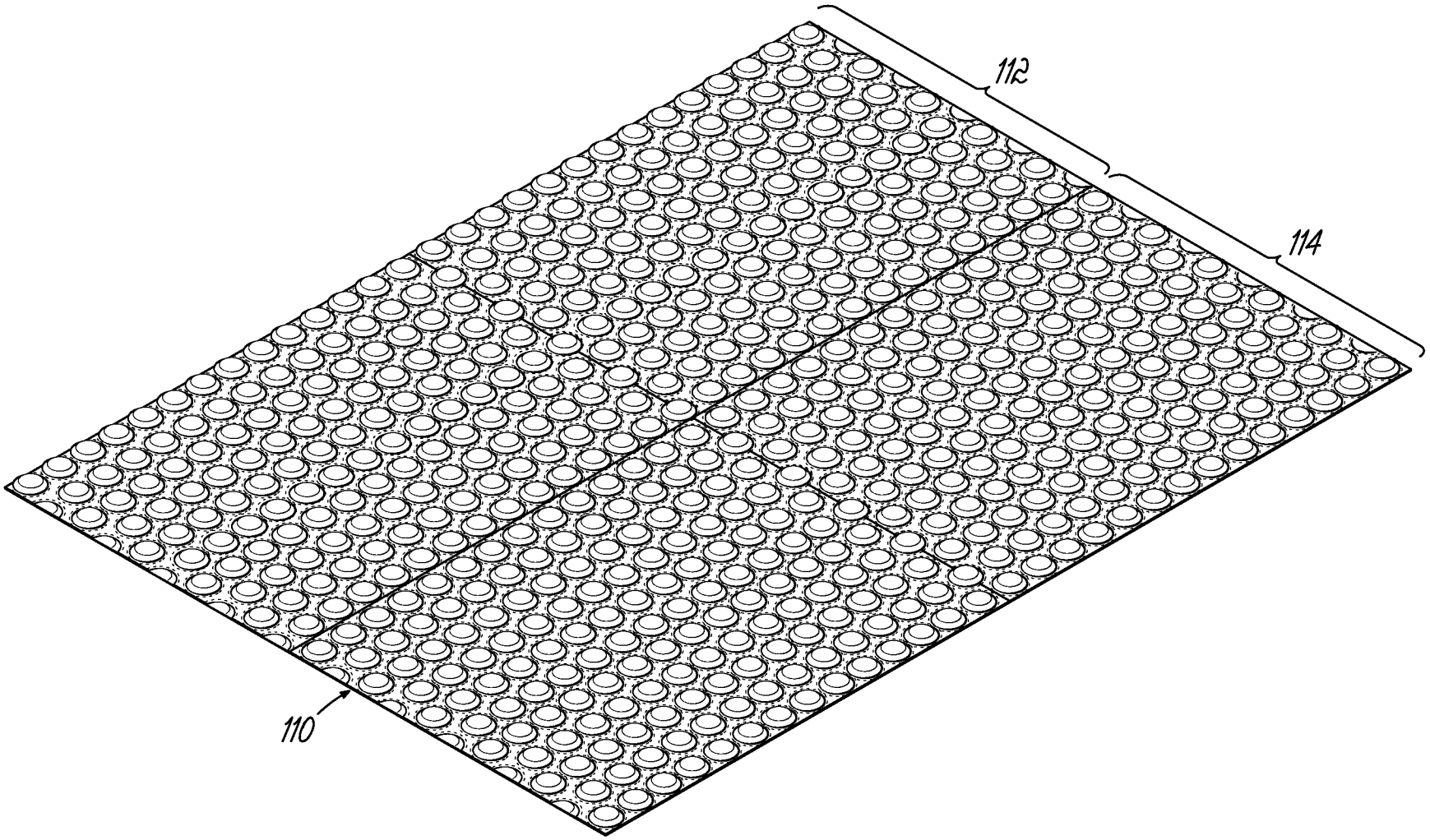
FIG. 13 is a perspective view of another posturized comfort layer.

FIG. 13 illustrates another posturized comfort layer 110 having two different areas or regions of firmness depending upon the mini coil springs within each of the areas or regions. The comfort layer 110 has a first section 112 and a second section 114. The size and number of segments in the seams, along with the type of material used to construct the posturized comfort layer 110, may be selected so at least two of the sections may have a different firmness due to different mini coil springs within different sections. Although two sections are illustrated in FIG. 13, any number of sections may be incorporated into a posturized comfort layer. Although each of the sections is illustrated being a certain size, they may be other sizes. The drawings are not intended to be limiting. Although FIG. 13 shows each of the segmented seams of comfort layer 110 being circular, posturized comfort layer 110 may have rectangular or square segmented seams, such as the seams shown in FIGS. 11 and 11A.

Figure 14:
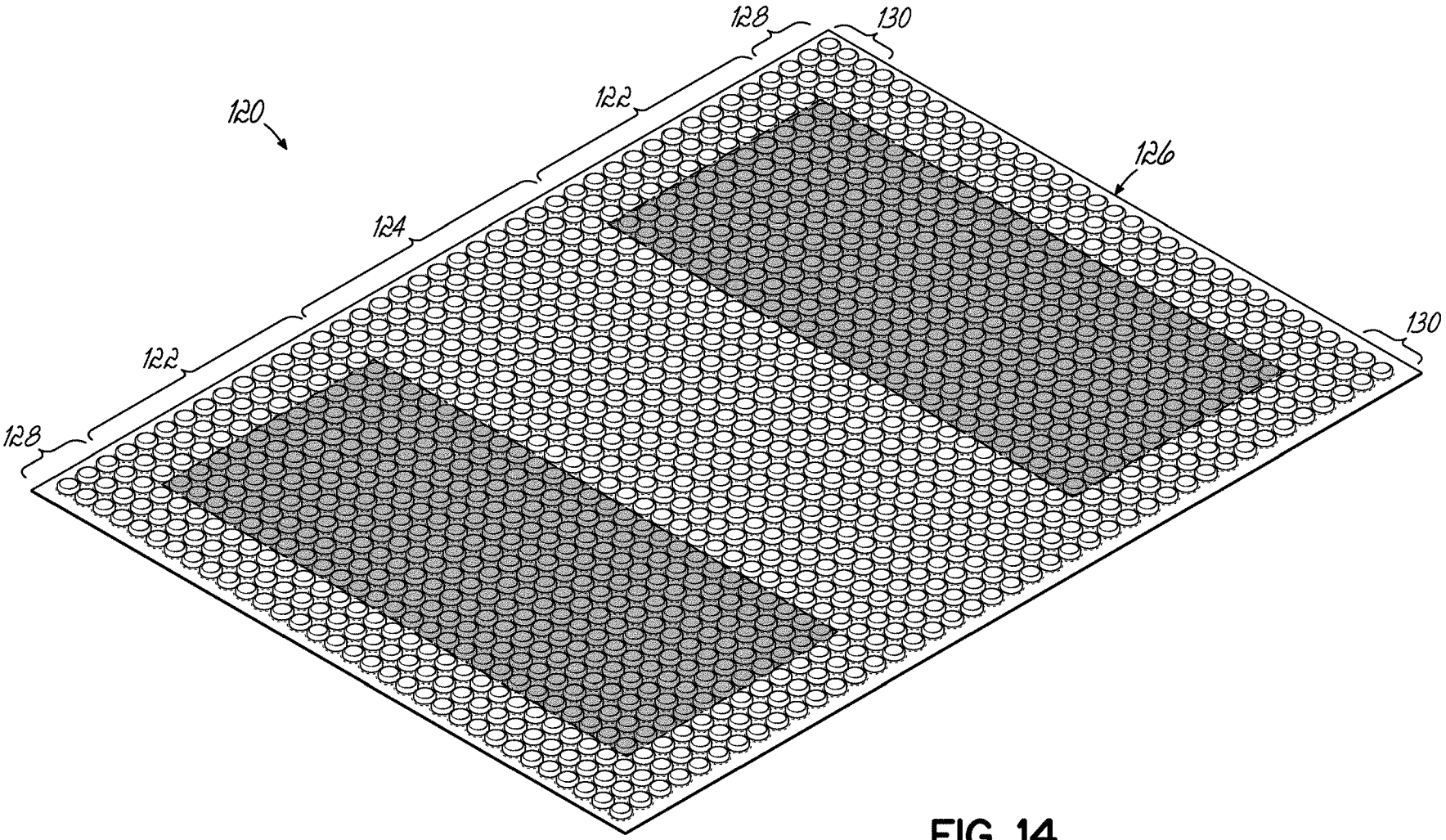
FIG. 14 is a perspective view of another posturized comfort layer.

FIG. 14 illustrates another posturized comfort layer 120 having two different areas or regions of firmness depending upon the mini coil springs within each of the areas or regions. The comfort layer 120 has two rectangular soft sections 122 and a firm section 124 therebetween. In addition, a perimeter section 126 extending around the perimeter is the same firmness as the firm section 124. The perimeter section 126 comprises two end sections 128 and two side sections 130. The size and number of segments in the seams, along with the type of material used to construct the posturized comfort layer 120, may be selected so at least two of the sections may have a different firmness due to different mini coil springs within different sections. Although three sections are illustrated in FIG. 14, any number of sections may be incorporated into a posturized comfort layer. Although each of the sections is illustrated being a certain size, they may be other sizes. The drawings are not intended to be limiting. Although FIG. 14 shows each of the segmented seams of comfort layer 120 being circular, the posturized comfort layer 120, may have rectangular segmented seams, such as the rectangular seams shown in FIGS. 11 and 11A.

While we have described several preferred embodiments of this invention, persons skilled in this art will appreciate that other semi-impermeable and non-permeable fabric materials may be utilized in the practice of this invention. Similarly, such persons will appreciate that each pocket may contain any number of coil springs or other type of spring, made of any desired material. Persons skilled in the art may further appreciate that the segments of the weld seams may be stitched, glued or otherwise adhered or bonded. Therefore, we do not intend to be limited except by the scope of the following appended claims.

We claim:

1. A mattress comprising:

a spring core;

a cushioning pad on top of the spring core;

a comfort layer on top of the cushioning pad, the comfort layer comprising a matrix of interconnected mini coil pocketed springs, each mini coil spring being contained within a pocket, said pocket having a weld seam around the pocket joining first and second pieces of fabric of the pocket, each weld seam having multiple weld segments;

said comfort layer having a center section and a perimeter section surrounding the center section, the mini pocketed springs within the pockets of the perimeter section being made of thicker wire than the wire from which the mini pocketed springs within the pockets of the center section.

2. The mattress of claim 1 wherein the weld seams of the comfort layer are circular and the weld segments of the pocket are curved.

3. The mattress of claim 1 wherein the weld seams of the comfort layer are rectangular and the weld segments of the pocket are straight.

4. The mattress of claim 1 wherein the weld segments of the weld seams of said pockets of the comfort layer are evenly spaced from each other.

5. The mattress of claim 1 wherein at least some of said mini coil springs of the comfort layer have a barrel shape.

6. The mattress of claim 1 wherein the mini coil springs of the comfort layer have a uniform diameter.

7. A mattress comprising:

a spring core;

a cushioning pad on top of the spring core;

a comfort layer on top of the cushioning pad, the comfort layer comprising a matrix of mini coil springs, a first piece of fabric on one side of the matrix of mini coil springs, a second piece of fabric on another side of the matrix of mini coil springs, the first and second pieces of fabric being joined with weld seams comprising weld segments around each of the mini coil springs to create gaps between the first and second pieces of fabric and individual pockets which contain the mini coil springs, wherein said comfort layer has different sections of different firmness due, at least in part, to the out-of-pocket height of the mini coil springs.

8. The mattress of claim 7 wherein said weld seams of the comfort layer are circular and the weld segments are curved and the same size.

9. The mattress of claim 7 wherein said weld segments of said weld seams of said pockets of the comfort layer are the same size.

10. The mattress of claim 7 wherein each of said mini coil springs of the comfort layer has the same shape.

11. The mattress of claim 7 wherein at least some of said mini coil springs of the comfort layer have a barrel shape.

12. The mattress of claim 7 wherein at least one of said pieces of fabric of the comfort layer comprises at least one layer of non-woven fabric material.

13. The mattress of claim 7 wherein said mini coil springs of the comfort layer in a relaxed condition are approximately 0.5 to 3.0 inches tall.

14. The mattress of claim 7 wherein at least some of said mini coil springs of the comfort layer have a uniform diameter.

15. A mattress comprising:

a spring core;

a cushioning pad on top of the spring core;

a comfort layer on top of the cushioning pad, the comfort layer comprising mini coil springs, a first piece of fabric on one side of the mini coil springs, a second piece of fabric on another side of the mini coil springs, the first and second pieces of fabric being joined with weld seams comprising weld segments around each of the mini coil springs to create gaps between the weld segments and individual pockets which contain the mini coil springs, wherein said comfort layer has different sections of different firmness due, at least in part, to the number of convolutions of the mini coil springs within the sections.

16. The mattress of claim 15 wherein the weld seams of the comfort layer are circular and the weld segments are curved.

17. The mattress of claim 15 wherein the weld seams of the comfort layer are rectangular and the weld segments are straight.

18. The mattress of claim 15 wherein the gaps of the comfort layer are the same size.

19. The mattress of claim 15 wherein the gaps of the comfort layer are different sizes.

20. The mattress of claim 15 wherein at least some of said mini coil springs of the comfort layer have a barrel shape.

* * * * *